US005095556A

United States Patent [19]

Franey

[11] Patent Number: 5,095,556

[45] Date of Patent: Mar. 17, 1992

[54] PORTABLE PERSONAL COMMODE

[76] Inventor: Joseph M. Franey, 7432 Landau Curve, Bloomington, Minn. 55438

[21] Appl. No.: 569,607

[22] Filed: Aug. 20, 1990

Related U.S. Application Data

[63] Continuation-in-part of Ser. No. 429,347, Oct. 31, 1989.

[51] Int. Cl.[5] ..... A47K 11/02

[52] U.S. Cl. ..... 4/460; 4/483; 4/484

[58] Field of Search ..... 4/460, 476, 478, 479, 4/480, 483, 484, 254, 312, 449, 458, 464–468, 474, 477, 481, 482, 485, 486, 578; 297/17

[56] References Cited

U.S. PATENT DOCUMENTS

| | | | |
|---|---|---|---|
| 56,724 | 7/1866 | Davis | 4/485 |
| 234,230 | 11/1880 | Bovey | 4/478 X |
| 550,613 | 12/1895 | Harvey | 4/478 |
| 577,136 | 2/1897 | Honeywell | 4/478 |
| 1,306,041 | 6/1919 | Wittmann | 4/460 |
| 1,412,379 | 4/1922 | Urban, Jr. | 4/458 X |
| 1,419,947 | 6/1922 | Schouten | 297/17 |
| 1,428,627 | 9/1922 | Grabfelder | 4/312 X |
| 1,575,131 | 3/1926 | Schumacher | 4/460 |
| 1,947,940 | 2/1934 | Isom | 4/478 |
| 2,340,788 | 2/1944 | Aylor | 297/17 |
| 2,431,538 | 11/1947 | Brief et al. | 4/476 |
| 2,521,200 | 9/1950 | Beckenhauer | 297/17 |
| 2,634,425 | 4/1953 | Sturwold | 4/599 |
| 2,752,610 | 7/1956 | Mabrey | 4/254 X |
| 2,849,726 | 9/1958 | Vay | 4/476 |

(List continued on next page.)

FOREIGN PATENT DOCUMENTS

| | | | |
|---|---|---|---|
| 77760 | 8/1919 | Austria | 4/449 |
| 2638628 | 5/1990 | France | 4/483 |
| 441843 | 2/1943 | Italy | 4/449 |

OTHER PUBLICATIONS

Activeaid ® Model 261 Original Multi-Purpose Chair © 1989.

Activeaid ® Model 276 Commode/Bath-Transfer Bench.

Activeacid ® Model 277 Tub/Commode Chair © 1989.

Medical Line Warehouse, 1990 Catalog, back cover, Folding Multi-Use Chair.

Hilltop Trailer Sales, Parts and Accessories Catalog, 1989 edition, pp. 94 and 96.

*Primary Examiner*—Ernest G. Cusick

*Assistant Examiner*—Robert M. Fetsuga

*Attorney, Agent, or Firm*—Peterson, Wicks, Nemer & Kamrath

[57] ABSTRACT

A foldable, portable personal commode is disclosed according to the teachings of the present invention including a case having an openable top and front. A toilet seat is pivotally mounted to a block secured in the case. A U-shaped support is pivotally mounted to the toilet seat and removably holds the toilet seat in its horizontal position when the free ends of its legs are vertically inserted in sockets secured to the front when it is in its open position. The toilet seat and U-shaped support may be pivoted generally parallel to each other and arranged vertically within the case allowing closing of the front and top of the case. L-shaped arm supports may be removably secured to the vertical sides of the U-shaped support to face either forward or rearward. A removable U-shaped back rest is adjustably inserted in the block of the case. The toilet seat includes affixed hardware which supports a removable collar which slideably receives the opening of a plastic bag retained thereon by a rubber band. The case acts as a space efficient, storage container for the internal components when positioned inside of the closed case which may then be easily carried by a handle attached to the top. The case forms the supporting structure for the toilet in its opened, operative position, with the bottom, front, and sides of the case forming an interlocking cube. The U-shaped support and the arm support(s) keep the center of gravity of the user well within the base formed by the bottom and front of the case to prevent sideways tipping.

20 Claims, 1 Drawing Sheet

U.S. PATENT DOCUMENTS

| | | | |
|---|---|---|---|
| 2,974,321 | 3/1961 | Salka | 4/476 |
| 3,050,741 | 8/1962 | Coleman | 4/480 |
| 3,080,568 | 3/1963 | Burnett | 4/602 |
| 3,258,291 | 6/1966 | Ezquerra | 4/483 X |
| 3,293,664 | 12/1966 | Coons | 4/599 |
| 3,447,167 | 5/1967 | Harding | 4/462 |
| 3,629,874 | 12/1971 | Beller | 4/462 |
| 3,969,778 | 7/1976 | Richards | 4/254 |
| 3,986,215 | 10/1976 | Amalfitano | 4/458 X |
| 3,992,727 | 11/1976 | Elkins | 4/311 |
| 4,031,572 | 6/1977 | Harding | 4/463 X |
| 4,205,404 | 6/1980 | Levins | 4/254 |
| 4,715,069 | 12/1987 | James | 4/254 |

PORTABLE PERSONAL COMMODE

CROSS REFERENCE

The present application is a continuation-in-part of design patent application Ser. No. 07/429,347 filed on Oct. 31, 1989.

BACKGROUND

The present invention relates generally to personal toilet devices, particularly to foldable personal commodes, as well as to portable, stowable personal commodes, and most particularly to portable, compact, sturdy, mechanically flexible, non-chemical personal portable commodes which offer the user a variety of operating options to meet his or her personal physical requirements.

While personal, portable commodes utilizing water and chemicals in a flush system have been in use for years, as well as various devices for the dry collection of human waste in a bag or solid container, the state of the art, prior to the present invention, has not included an invention which offers such portability, stability, compactness, sanitary features, novel systematic collection of waste and flexibility of operation.

While the present invention can be effectively used by ambulatory, nor non-impaired, persons, it is particularly suited to, and primarily designed for, individuals who have physical disabilities which prevent them from easy access to and operation of standard private or public toilet facilities; i.e. those found in homes, restaurants, hotels, motels, cabins, boats, recreational vehicles, campgrounds, vans, certain airplanes and other typical commode locations.

Further, such a device is useful in home health care, post operative and/or rehabilitative situations where the individual may have difficulty due to his impairment in accessing conventional toilet facilities. Prior personal portable commodes did not satisfy such needs for a variety of reasons, including but not limited to design inadequacies, cost, weight, lack of stability, small platform size, small seat size, maintenance requirements, service requirements, and other operational drawbacks.

SUMMARY

The present invention solves these needs and other problems in the field of personal commodes by providing, in the most preferred form, a toilet seat and a front which are pivotable between closely spaced, parallel, stowed, vertical positions and spaced, parallel, operative, horizontal positions, with a removable member extending between the bottom of the toilet seat and the front in their horizontal positions for holding the toilet seat parallel to the front and perpendicular to the back.

It is thus an object of the present invention to provide a novel personal commode.

It is further an object of the present invention to provide such a novel personal commode which is stowable.

It is further an object of the present invention to provide such a novel personal commode which is portable.

It is further an object of the present invention to provide such a novel personal commode which is easy to clean and maintain.

It is further an object of the present invention to provide such a novel personal commode which is very stable.

It is further an object of the present invention to provide such a novel personal commode which is easy for the user to get onto and off, particularly for physically handicapped persons.

It is further an object of the present invention to provide such a novel personal commode which offers the user a variety of operational options.

It is further an object of the present invention to provide such a novel personal commode which is durable and weather resistant.

It is further an object of the present invention to provide such a novel personal commode which is relatively inexpensive to fabricate.

It is further an object of the present invention to provide such a novel personal commode which is comparatively lightweight.

It is further an object of the present invention to provide such a novel personal commode which is compact.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 3:
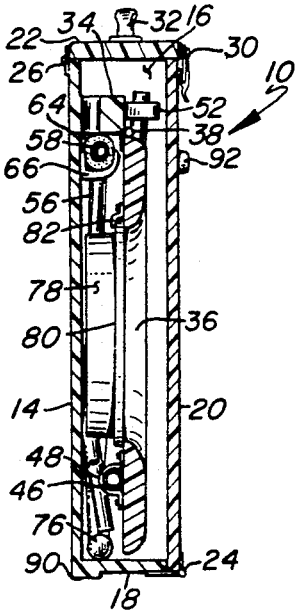
FIG. 3 shows a cross sectional view of the portable personal commode of FIG. 1 in a stowed condition according to section line 3—3 of FIG. 2.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "side", "front", "back", "end", "rear", "forward", "rearward", and similar terms are used herein, it should be understood that these terms have reference only to the structure shown in the drawings as it would appear to a person viewing the drawings and are utilized only to facilitate describing the invention.

DESCRIPTION

A portable personal commode according to the preferred teachings of the present invention is shown in the drawings and generally designated 10. Commode 10 provides a self-contained, portable, fold-out toilet system for personal use. Specifically, commode 10 includes a case 12 having back 14, opposite sides 16, bottom 18, front 20, and top 24, each of generally planar, rectangular shapes. Sides 16 are integrally attached to and upstand generally perpendicularly from the opposite ends of bottom 18 to form a U-shape, with the widths of sides 16 and bottom 18 being equal. Back 14 is integrally attached to and extends generally perpendicularly from the rear edges of sides 16 and bottom 18. Back 14 and sides 16 have equal heights. Front 20 is pivotally mounted to bottom 18 about an axis which is generally parallel to the front edge of bottom 18 opposite to back 14 by any suitable means such as hinges 24. Front 20 is pivotal from a closed position abutting with the front edges of sides 16 and bottom 18 defining a front opening and an open position extending from case 12 forwardly of its front opening generally parallel to bottom 18. Front 20 has a size and shape corresponding to back 14. Top 22 is pivotally mounted to back 14 about an axis which is generally parallel to the top edge of back 14 opposite to bottom 18 by any suitable means such as hinges 26. The axis of top 22 is parallel to and spaced above and behind the axis of front 20. Top 22 is pivotal from a closed position abutting with the top edges of sides 16 and back 18 and of front 20 in its closed position and an open position which extends beyond the plane of the front face of back 14. Top 22 has an appropriate size and shape corresponding to bottom 18 with bottom 18 inserted between sides 16 and between back 18 and front 20 while top 22 extends over sides 16 and over back 18 and front 20 in the preferred form. Foldable braces 28 may be provided between front 20 and sides 16 for locking or holding front 20 in its open position. Suitable latches 30 such as draw catches as shown may be provided for locking front 20 and top 22 together and in their closed positions. Top 22 may also include a suitable handle 32 for carrying case 12 on the outside face of top 22 when top 22 is in its closed and locked position. It can then be appreciated that in its closed condition, case 12 forms a suitcase or briefcase type container for commode 10.

Case 12 further includes a block 34 integrally connected to back 14 and extending between and integrally connected to sides 16. Block 34 has a front face which is spaced behind the front edges of sides 16, bottom 18, and top 22 in its closed position. It can be appreciated that back 14, sides 16, bottom 18, and block 34 may be formed of individual pieces which are integrally connected together such as by welding, by mechanical fastening, or may be cast as one or more pieces.

Commode 10 further includes a standard elongated toilet seat 36 which is pivotally mounted to block 34 by any suitable means such as hinges 38. Toilet seat 36 is pivotal between a first, generally horizontal position extending forwardly of the front opening of case 12 perpendicular to back 14 and parallel to front 20 in its open position and a second, generally vertical or stowed position extending downwardly from the axis of toilet seat 36 and from block 34 and parallel to back 14. The axis of seat 36 is at an elevated height and generally parallel to and spaced from bottom 18 a distance generally equal to or exceeding the length of seat 36. The axis of toilet seat 36 is also located parallel to and spaced above the axis of front 20 and spaced below and in front of the axis of top 22. Seat 36 has a width less than the width of back 14 and the spacing between sides 16. Thus, in the stowed position, toilet seat 36 is located within the front opening defined by the front edges of back 14 and sides 16 and the back face of front 20 in its closed position. In the most preferred form, toilet seat 36 is positioned somewhat higher in its horizontal position than seats in standard residential commodes.

For supporting or removably holding seat 36 in its horizontal position, commode 10 includes a U-shaped support 40 which extends between toilet seat 36 and front 20 in a spaced relation from the axes of toilet seat 36 and of front 20. In the preferred form, support 40 is pivotally connected by an axis located adjacent the front of toilet seat 36 between a first position generally parallel to toilet seat 36 and a second position extending generally perpendicular to toilet seat 36. The axis of support 40 is parallel to and spaced from the axes of front 20, of toilet seat 36, and of top 22. In the preferred form, support 40 includes first and second legs 42 and 44 extending generally perpendicularly from opposite ends of central portion 46. The spacing of legs 42 and 44 is greater than the width of toilet seat 36 but less than the width of back 14 or the spacing between sides 16. Thus, in the stowed position, toilet seat 36 is located within legs 42 and 44 of support 40. Central portion 46 is pivotally mounted to seat 36 such as by U-shaped conduit brackets 48 having their free ends secured to the bottom face of toilet seat 36 for rotatably mounting central portion 46 to toilet seat 36. Suitable provisions are provided to hold support 40 in its second position when toilet seat 36 is in its horizontal position such as by insertion of the free ends of legs 42 and 44 in locking cups or sockets 50 secured to the back face of front 20. Suitable provisions may be provided to hold support 40 in its first position when toilet seat 36 is in its stowed position and specifically to prevent support 40 from pivoting out the front opening defined by sides 16 and bottom 18 and past the top face of toilet seat 36 such as a snap type, slide interlock 52 shown as being of the broom holder type.

Commode 10 further includes an adjustable backrest 54 which can be removed for storage inside of case 12. Specifically, in the preferred form, backrest 54 is U-shaped and includes first and second legs 56 extending generally perpendicularly from opposite ends of central portion 58. Legs 56 are insertably received in first and second, spaced, parallel apertures 60 formed in block 34. The height of central portion 58 above block 34 and thus toilet seat 36 may be adjusted by any suitable means such as cotter keys 62 which extend through legs 56 at the desired height and which abut with the top face of block 34 to prevent legs 56 from sliding further into apertures 60. Central portion 58 may include suitable padding 64 such as the tubular form shown. Provisions may be provided for removably holding backrest 54 in a stowed condition inside of case 12 such as hooks or brackets 66 secured to back 14 below block 34 in which central portion 58 of backrest 54 may be placed.

Commode 10 further includes removable, handle bars or arm supports 68 which in the preferred form are tubular and L-shaped. Specifically, the lower end of the first leg 70 is removably attached to the outside, vertical sides of legs 42 and 44 of support 40 by any suitable means such as bolts 72 having wing nuts as shown, with leg 70 extending generally contiguous with and in line with leg 42 or 44 above central portion 46. Second leg 74 extends generally perpendicular to leg 70 and generally in a direction perpendicular to central portion 46. In the most preferred form, arm supports 68 may be secured to support 40 with leg 74 extending forwardly of support 40 as shown in solid in FIG. 1 or with leg 74 extending rearwardly of support 40 as shown in phantom in FIG. 1. Leg 74 may include a suitable non-slip grip 76 such as that shown in FIG. 1. It can be appreciated that leg 74 and grip 76 may be formed of a size to slideably receive the tubular core of a roll of toilet paper which provides considerable convenience to the user.

Commode 10 further includes suitable provisions for catching and retaining human wastes. In the preferred form, a flexible collar 78 having a circular form which differs from the oval shape of the central opening of toilet seat 36 is forced into position to conform to the oval opening of toilet seat 36. In the most preferred form, collar 78 is removably attached to toilet seat 36. Collar 78 specifically includes a rim which is slid under and forced against stationary clamps 82 and then held in that position until secured by rotatable clamp 84 which is rotated 90° to abut against rim 80. The pressure of flexible collar 78 against clamps 82 and rotatable clamp 84 locks collar 78 in position. The spring action of collar 78 against clamps 82 and 84 assures that collar 78 will not accidentally release from the bottom face of toilet seat 36 until the user chooses to remove collar 78. To remove collar 78, the operator rotates rotatable clamp 84 back 90° to release the spring tension on collar 78 against clamps 82.

It should be further noted that the axis of toilet seat 36 is located a distance in front of back 14 generally equal to or exceeding the combined height of collar 78 and toilet seat 36.

A disposable plastic bag 86 or the like which is preferably biodegradable and may be opaque or transluscent is slideably received on and supported by collar 78 and removably held or secured thereon such as by the use of a rubber or other elastic band 88. It can then be appreciated that bag 86 may be removed and tied in a sanitary manner without the user coming into contact with the contents of bag 86 or surfaces which would be normally exposed to such wastes. Specifically, when it is desired to properly dispose of any waste contained in bag 86, rubber band 88 may be moved on bag 86 to a position below collar 78 such as by rolling rubber band 88 down on bag 86 and off collar 78. When positioned below collar 78, rubber band 88 will at least partially cinch the open top of bag 86. After bag 86 is slid off collar 78, bag 86 can be closed by any suitable means including standard twist-ties which typically accompanies a supply of bags 86. It can then be appreciated that contact would only be made with the outer surface of bag 86 and possibly the outer surface of collar 78, both of which are not normally exposed to waste during use of commode 10. Rubber band 88 is subsequently used to secure a replacement bag 86 to collar 78 which is then reattached under toilet seat 36 for the next use.

Figure 1:
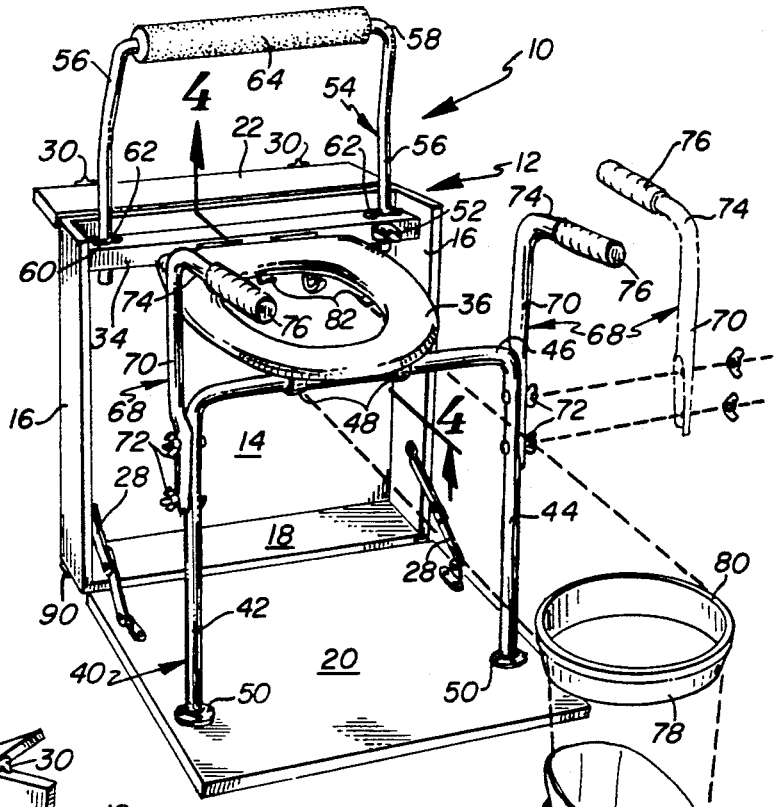
FIG. 1 shows a perspective view of a portable personal commode in an operative condition according to the preferred teachings of the present invention, with portions being exploded therefrom.
Figure 2:
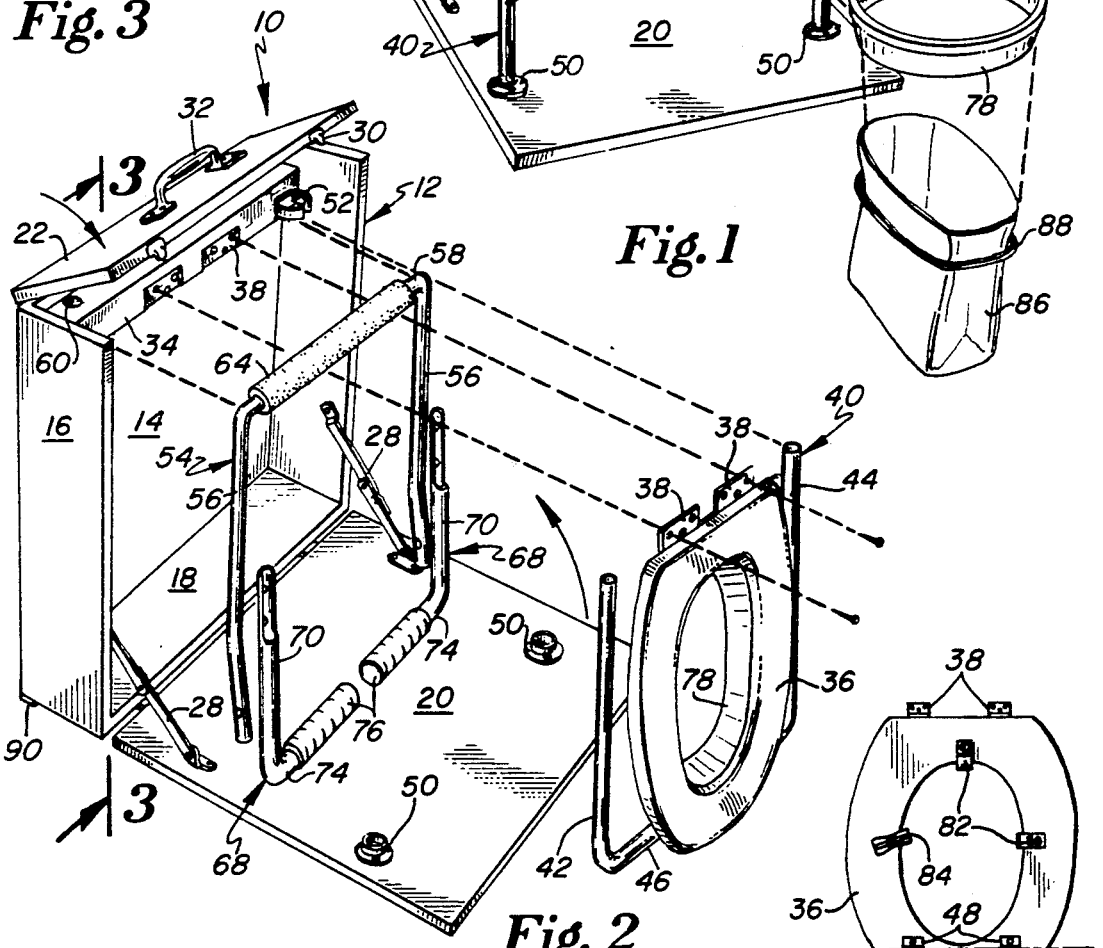
FIG. 2 shows an exploded, perspective view of the portable personal commode of FIG. 1 with the internal components being exploded from the case.
Figure 4:
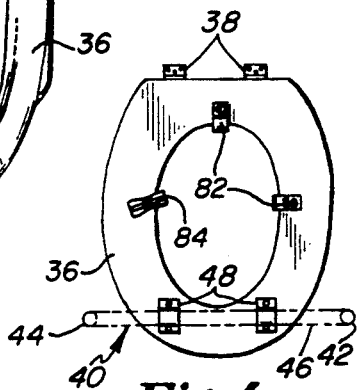
FIG. 4 shows a partial, sectional plan view of the toilet seat of the portable, personal commode of FIG. 1 according to section line 4—4 of FIG. 1.

It can then be appreciated that in an assembled relation as shown in FIG. 1, case 12 becomes the supporting stand for commode 10 and does not require any other external support. Commode 10 is not prone to collapsing due to the locking of braces 28 holding front 20 in its open position relative to bottom 18 and due to the insertable interconnect of legs 42 and 44 within sockets 50, with support 40 being pivotally connected to toilet seat 36 and with toilet seat 36 being pivotally connected to block 34 of case 12. Further, bottom 18 and front 20 of case 12 provide an extremely stable base for commode 10, with the spacing of legs 42 and 44 keeping the center of gravity of the user well within that base. Thus, commode 10 is nearly impossible to tip over. In the preferred form shown, an elongated rib 90 may be provided on bottom 18 adjacent back 14 and rubber or plastic bumpers 92 may be provided on the outer face of front 20 spaced from hinges 24 to compensate for the height of hinges 24 with front 20 in its open position and to prevent case 12 from slipping when an individual transfers onto or off toilet seat 36. In addition to leveling bottom 18 and front 20, bumpers 92 also provide support for front 20 in its open position and protect latches 30 from damage or foreign material when commode 10 is in use and the user's weight is placed on toilet seat 36.

Arm supports 68 may be variably positioned to suit the particular user's preference, according to the placement of commode 10 in relation to walls or other obstructions, or to otherwise assist in ease of user transfer, with either right or left entry. In this regard, it should be noted that the extended width of central portion 46 assures that sufficient access is provided between arm supports 68 as well as access for placement or removal of bag 86 on collar 78. Arm supports 68 may then be utilized to assist the user in getting onto or off commode 10, as well as for assistance during use of commode 10. Backrest 54 provides comfort, security and leverage for the user of commode 10.

When not in use, commode 10 can be folded into case 12 for storage and/or transport. Specifically, backrest 54 can be removed by pulling legs 56 upward out of apertures 60 and may then be hung on hooks 66. Arm supports 68 can be removed from support 40 such as by removing bolts 72 and may then be placed in the corners between sides 16 and bottom 18 in a noninterfering relation with legs 56 of backrest 54 supported on hooks 66. Legs 42 and 44 of support 40 may be removed from sockets 50 by pulling legs 42 and 44 upward out of sockets 50 in the preferred form. Support 40 may then be pivoted within brackets 48 into its first position parallel to seat 36. Seat 36 may then be pivoted to its second, stowed position. In the stowed position, leg 44 may be pushed into interlock 52 to restrict pivoting of support 40 within brackets 48 and of toilet seat 36 about hinges 38 while in the stored, retracted condition. The center of braces 28 may be pushed downward to unlock braces 28 and allow pivoting of front 20 about hinges 24 to its closed position generally parallel to toilet seat 36 in its vertical position. Top 22 may be pivoted about hinges 26 to its closed position and latches 30 are engaged to hold front 20 and top 22 together. It can then be appreciated that case 12 may then be easily transported utilizing handle 32, with the remaining components of commode 10 conveniently stowed therein. It can then be appreciated that the spaces around and in the internal components of commode 10 and inside of case 12 may be utilized to store various articles which are utilized in connection with commode 10 such as toilet paper, sponges, pads, cleaning material, or the like. It can be further appreciated that commode 10 in its stowed condition according to the present invention is of a small size which can be easily stored indoors such as under a bed, in a closet, or the like, or stored in vehicles and the like such as in campers, vans, and other recreational vehicles, in car trunks, and the like, and can be transported like a piece of luggage on airlines, buses, cars, or other means of private or public transportation. Thus, commode 10 is self-contained, completely portable, transportable and storable vertically or horizontally, face up or face down, and can be deployed quickly inside or outdoors by one person.

It can be appreciated that block 34 performs multiple functions in commode 10. First, it is the rear support for toilet seat 36 and provides reinforcement to back 14 and sides 16 of case 12 to allow such support. Second, it is the attachment point for backrest 54 in its operative condition and for support 40 in its stowed condition. Additionally, block 34 spaces toilet seat 36 away from back 14 to allow toilet seat 36 and collar 78 to be parallel to back 14 in their stowed condition.

In the most preferred but not exclusive form, case 12, toilet seat 36, and collar 78 are formed of plastic material while support 40, backrest 54, and arm supports 68 are formed of tubing such as of steel, aluminum, or reinforced plastic. This choice of materials is particularly advantageous for durability and for weight reduction reasons allowing commode 10 to be easily carried and transported. Further, such materials are weatherproof and may be easily cleaned and sterilized such as with steam. Cleaning and sterilizing would be especially important when commode 10 is placed for rental such as to recuperating patients who are temporarily unable to use traditional facilities.

Commode 10 according to the teachings of the present invention is a unique product in several markets including paraplegic, rehabilitative, post-operative, and health-care areas. Commode 10 can be utilized in all situations where portable chemical toilets are now being used and in many other applications where chemical toilets are not acceptable due to cost, weight, maintenance, inconvenience, inappropriate design, instability, small platform size, and/or small seat size. For example, commode 10 can be used by paraplegics and other handicapped persons who would like to enjoy camping, boating, fishing, ice fishing, hunting, traveling and other recreational activities but are limited by a lack of personal hygiene equipment or facilities. Specifically, commode 10 may be transported like any other piece of luggage to the desired activity at whatever location. Similarly, commode 10 can be utilized in motel rooms or the like where access to facilities can not be obtained, for example where a wheel chair will not go through bathroom doors or stalls or will not fit in the space provided for the facilities. Likewise commode 10 can be utilized at bedside for person who cannot walk to a bathroom or who have night time evacuation needs which preclude assistance by another person. For example, in addition to paraplegics and other handicapped or physically disabled persons, such persons may be aged and confined to bed, seriously arthritic, recovering from surgery or an accident, have balance disorders, or just temporarily incapacitated and restricted to bed.

Commode 10 according to the teachings of the present invention requires no chemicals, flushing, special disposal location or expensive resupply of deodorants and/or disinfectants as required in other portable toilet systems such as of the chemical type.

It can be appreciated that a cardboard, plywood, or other flat surface can be extended over toilet seat 36 with arm supports 68 and/or back rest 54 removed, with a suitable cloth or cover extending over commode 10. Commode 10 could then function as a night stand or the like for medicine, phone, water, and the like when not in use in a toilet function.

Now that the basic teachings of the present invention have been explained, many extensions and variations will be obvious to one having ordinary skill in the art. For example, in the most preferred form, support 40 is shown as U-shaped and swings away with toilet seat 36 and is believed to be advantageous at least because they remain attached to each other and to case 12. However, support 40 may take other forms including but not limited to legs 42 and 44 which are insertable in sockets 50 secured to front 20 and in similar sockets secured to toilet seat 36.

Likewise, although collar 78 upon which bag 86 is slideably received is utilized in the preferred form and is believed to be advantageous, other methods may be utilized for waste collection. For example, a pail preferably lined with a disposable plastic bag can be removably attached to toilet seat 36 or positioned independently beneath toilet seat 36 thus allowing a paraplegic user perineal access which is frequently necessary for digital anal stimulation to trigger a bowel evacuation.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Personal commode comprising, in combination: a toilet seat; means for pivotally mounting the toilet seat about an axis at an elevated height, with the toilet seat being pivotable between a generally horizontal position and a generally vertical position extending downwardly from the toilet seat axis; a substantially planar front; means for pivotally mounting the front about an axis parallel to and spaced below the toilet seat axis, with the front being pivotable between an open position and a closed position, with the front in its open position being generally parallel to and spaced below the toilet seat in its horizontal position and the front in its closed position being generally parallel to the toilet seat in its vertical position; means for removably holding the toilet seat in its horizontal position; at least a first L-shaped arm support including a first arm having a first end and a second end and a second arm having a first end and a second end, with the first ends of the arms being interconnected together; and means for removably attaching the second end of the first arm support relative to the toilet seat with the second arm being parallel to the toilet seat and extending above said toilet seat and capable of being attached in a forward and rearward direction from the first arm.

2. The personal commode of claim 1 wherein the removably holding means comprises at least a first leg extending between the toilet seat and the front in a spaced relation from the axes of the toilet seat and the front, with the removably attaching means removably attaching the second end of the first arm to the leg with the first arm extending generally contiguous with and in line with the leg.

3. The personal commode of claim 2 wherein the first leg and the arm support are formed of tubing.

4. The personal commode of claim 2 wherein the removably holding means comprises a U-shaped support including a central portion having first and second ends, with the first leg extending from the first end of the central portion and a second leg extending from the second end of the central portion; and means for rotatably mounting the central portion of the U-shaped support to the toilet seat about a leg axis in a spaced relation from the axis of the toilet seat.

5. Personal commode comprising, in combination: a toilet seat; means for pivotally mounting the toilet seat about an axis at an elevated height, with the toilet seat being pivotable between a generally horizontal position and a generally vertical position extending downwardly from the toilet seat axis; a substantially planar front; means for pivotally mounting the front about an axis parallel to and spaced below the toilet seat axis, with the front being pivotable between an open position and a closed position, with the front in its open position being generally parallel to and spaced below the toilet seat in its horizontal position and the front in its closed position being generally parallel to the toilet seat in its vertical position; at least a first leg for removably holding the toilet seat in its horizontal position, with the leg removably connecting between the toilet seat and the front in a spaced relation from the axes of the toilet seat and the front, wherein the leg includes a free end opposite to the toilet seat; and means located on the front for removably securing the free end of the leg when the toilet seat is in its horizontal position and when the front is in its open position.

6. The personal commode of claim 5 wherein the removably securing means comprises a locking socket for insertably receiving the free end of the leg.

7. The personal commode of claim 6 wherein the leg is formed of tubing.

8. Personal commode comprising, in combination: a toilet seat; means for pivotally mounting the toilet seat about an axis at an elevated height, with the toilet seat being pivotable between a generally horizontal position and a generally vertical position extending downwardly from the toilet seat axis; a substantially planar front; means for pivotally mounting the front about an axis parallel to and spaced below the toilet seat axis, with the front being pivotable between an open position and a closed position, with the front in its open position being generally parallel to and spaced below the toilet seat in its horizontal position and the front in its closed position being generally parallel to the toilet seat in its vertical position; and means for removably holding the toilet seat in its horizontal position, with the removably holding means extending between the toilet seat and the front in a spaced relation from the axes of the toilet seat and the front; wherein the removably holding means comprises a U-shaped support including a central portion having first and second ends, a first leg extending from the first end of the central portion and a second leg extending from the second end of the central portion; and means for rotatably mounting the central portion of the U-shaped support to the toilet seat about an axis parallel to and spaced from the toilet seat axis and the front axis, with the first and second legs being pivotable between a parallel position generally parallel to and abutting with the toilet seat and a perpendicular position generally perpendicular to the toilet seat.

9. The personal commode of claim 8 further comprising, in combination: at least a first arm support; and means for removably attaching the arm support to the first or second leg of the U-shaped support.

10. The personal commode of claim 9 wherein the arm support is L-shaped and includes a first arm having a first end and a second end and a second arm having a first end, with the first ends of the arms being interconnected together, with the removably attaching means removably attaching the second end of the first arm to the leg with the first arm extending generally contiguous with and in line with the leg and with the second arm extending either in a forward or rearward direction.

11. The personal commode of claim 8 wherein the U-shaped support is formed of tubing.

12. Personal commode comprising, in combination: a toilet seat; a block; means for pivotally mounting the toilet seat about an axis at an elevated height, with the toilet seat being pivotably mounted by the pivotally mounting means to the block between a generally horizontal position and a generally vertical position extending downwardly from the toilet seat axis; means for removably holding the toilet seat in its horizontal position; a backrest including at least a first leg; and means for insertably receiving the first leg of the backrest in the block for removably holding the backrest in a position behind the toilet seat.

13. The personal commode of claim 12 wherein the backrest removably holding means comprises means for removably holding the backrest at differing heights behind the toilet seat comprising means extending through the leg of the backrest for abutting with the block for adjusting the extent that the leg is insertably received in the block.

14. The personal commode of claim 12 wherein the backrest is U-shaped and further includes a central portion having first and second ends and a second leg, with the first leg extending from the first end of the central portion and the second leg extending from the second end of the central portion; and wherein the insertably receiving means includes means for insertably receiving the second leg of the backrest.

15. The personal commode of claim 12 wherein the backrest is formed of tubing.

16. Personal commode comprising, in combination: a toilet seat; means for pivotally mounting the toilet seat about an axis at an elevated height, with the toilet seat being pivotable between a generally horizontal position and a generally vertical position extending downwardly from the toilet seat axis; a substantially planar front; means for pivotally mounting the front about an axis parallel to and spaced below the toilet seat axis, with the front being pivotable between an open position and a closed position, with the front in its open position being generally parallel to and spaced below the toilet seat in its horizontal position and the front in its closed position being generally parallel to the toilet seat in its vertical position; means for removably holding the toilet seat in its horizontal position; a case having a front opening; wherein the front pivotally mounting means comprises means for pivotally mounting the front to the case, with the front closing the front opening of the case in the closed position and with the front in its open position extending from the case forwardly of the front opening; and wherein the toilet seat pivotally mounting means comprises means for pivotally mounting the toilet seat to the case, with the toilet seat in its vertical position located within the case and the front opening of the case and with the toilet seat in its horizontal position extending from the case forwardly of the front opening.

17. The personal commode of claim 16 wherein the case is portable and includes a handle for carrying the case.

18. The personal commode of claim 17 wherein the case includes first and second sides, a bottom having first and second ends, with the first side upstanding from the first end of the bottom and the second side upstanding from the second end of the bottom, wherein the front pivotally mounting means comprises means for pivotally mounting the front to the bottom; and a block extending between the first and second sides spaced from the bottom, wherein the toilet seat pivotally mounting means comprises means for pivotally mounting the toilet seat to the block.

19. The personal commode of claim 18 wherein the case further comprises, in combination: a back interconnected to the first and second sides and the bottom; a top; and means for pivotally mounting the top about an axis parallel to and spaced from the toilet seat axis and the front axis, with the top having a closed position and an open position, with the top in its closed position abutting with the back and the sides and the front in its closed position and with the top in its open position extending rearwardly of the back of the case.

20. Personal commode comprising, in combination: a toilet seat including a central opening; means for pivotally mounting the toilet seat about an axis at an elevated height, with the toilet seat being pivotable between a generally horizontal position and a generally vertical position extending downwardly from the toilet seat axis; a substantially planar front; means for pivotally mounting the front about an axis parallel to and spaced below the toilet seat axis, with the front being pivotable between an open position and a closed position, with the front in its open position being generally parallel to and spaced below the toilet seat in its horizontal position and the front in its closed position being generally parallel to the toilet seat in its vertical position; means for removably holding the toilet seat in its horizontal position, with the removably holding means extending between the toilet seat and the front in a spaced relation from the axes of the toilet seat and the front; means removably secured to the toilet seat for catching waste received through the central opening of the toilet seat; wherein the catching means comprises a collar extending downwardly from the toilet seat concentric with the central opening, a bag for slidable receipt on the collar, and means for releasably holding the bag on the collar; and wherein the catching means further comprises means for removably attaching the collar to the toilet seat, with the collar having a form differing from that of the central opening of the toilet seat, with the removably attaching means conforming the collar to the central opening of the toilet seat to place the collar under pressure for locking the collar in position.

* * * * *